United States Patent [19]

Motosugi et al.

[11] Patent Number: 4,975,408

[45] Date of Patent: Dec. 4, 1990

[54] THERMOSENSITIVE RECORDING MATERIAL

[75] Inventors: Takanori Motosugi; Hisashi Sakai; Hiroshi Yaguchi; Hideo Aihara, all of Numazu, Japan

[73] Assignee: Ricoh Company, Ltd., Tokyo, Japan

[21] Appl. No.: 224,400

[22] Filed: Jul. 26, 1988

[30] Foreign Application Priority Data

Jul. 27, 1987 [JP] Japan ..... 62-186862

[51] Int. Cl.[5] ..... B41M 5/18

[52] U.S. Cl. ..... 503/226; 427/152; 503/200

[58] Field of Search ..... 427/150–152; 428/304.4, 318.4, 913, 914; 503/200, 226

[56] References Cited

U.S. PATENT DOCUMENTS 4,798,820 1/1989 Yaguchi et al. ..... 428/488.1

FOREIGN PATENT DOCUMENTS 5093 1/1984 Japan ..... 503/207

225987 12/1984 Japan ..... 503/207

*Primary Examiner*—Pamela R. Schwartz

*Attorney, Agent, or Firm*—Oblon, Spivak, McClelland, Maier & Neustadt

[57] ABSTRACT

A thermosensitive recording material which comprises a support, an intermediate layer including a foamed portion with minute voids, having a smoothness of 2,000 seconds or more in terms of Bekk's smoothness, and a thermosensitive coloring layer, successively formed on the support, and which layers show the compression strain of 20% or more when a pressure of 0.55 kg/cm$^2$ is applied in accordance with the Japanese Industrial Standards (JIS) P-8118. This thermosensitive recording material shows the compression strain of 5% or more as a whole when a pressure of 0.55 kg/cm$^2$ is applied in accordance with the JIS P-8118.

15 Claims, No Drawings

THERMOSENSITIVE RECORDING MATERIAL

BACKGROUND OF THE INVENTION

1. Field of the Invention:

The present invention relates to a thermosensitive recording material, and more particularly to an improved thermosensitive material comprising a support, an intermediate layer including a foamed portion with minute voids formed on the support, and a thermosensitive coloring layer formed on the intermediate layer.

2. Discussion of Art:

It is conventionally known that a colorless or light-colored coloring leuco dye reacts with a color developer such as an organic acidic material to be colored upon application of heat thereto until the leuco dye and the color developer are fused. Thermosensitive recording materials utilizing this coloring reaction are conventionally known as are disclosed, for instance, in Japanese Patent Publications 43-4160 and 45-14039.

Recently, those thermosensitive recording sheets have been employed in a variety of fields, for instance, for use with recorders for measurement instruments, terminal printers for computers, facsimile apparatus, automatic ticket vending apparatus, and bar code readers.

In accordance with recent remarkable improvements in the application of the above-mentioned recording apparatus to a variety of new fields and in the performance thereof, there is a great demand for thermosensitive recording sheets which can complement those improved apparatus. More specifically, there are demanded thermosensitive recording sheets capable of yielding sharp images with high density at a small amount of thermal energy with the advance of the thermal head speed. In addition, thermosensitive recording sheets are required to sufficiently satisfy thermal head matching properties such as not forming any dust from the recording material in the course of thermosensitive recording by use of the thermal head which comes into contact with the surface of the thermosensitive recording material and not sticking to the thermal head.

Color development on the thermosensitive recording sheet can be attained by the melting of a coloring leuco dye or a color developer or both of them and the reaction of the two to induce a color in the leuco dye under the application of thermal energy from the thermal head.

As a method of increasing the thermal coloring sensitivity of the thermosensitive recording material, there is widely known a method of adding to the thermosensitive recording material a thermofusible material which melts at a temperature lower than the melting points of the employed leuco dye and the color developer and is capable of dissolving therein the leuco dye and color developer when melted.

A variety of thermofusible materials for use in this method has been proposed, for example, nitrogen-containing compounds such as acetamide, stearamide, m-nitroaniline, and phthalic acid dinitrile in Japanese Laid-Open Patent Application 49-34842; acetoacetic anilide in Japanese Laid-Open Patent Application 52-106746; and alkylated biphenyl alkanes in Japanese Laid-Open Patent Application 53-39139.

However, in accordance with the recent development of a high speed thermal facsimile apparatus, it has become a common practice to energize and drive a thermal head at high speed. Under such circumstances, there is a problem of undesirable color development, so that the background of the thermosensitive recording sheet is also colored due to the build-up of thermal energy in the thermal head and therearound in the course of repetition of high speed thermosensitive recording. Therefore to solve this problem is one of the most important subjects to be addressed in order to enhance the dynamic thermal coloring sensitivity in conventional thermosensitive recording materials, without decreasing the coloring initiation temperature. In conventional thermosensitive recording materials the dynamic thermal coloring sensitivity cannot be increased unless a large amount of the above-mentioned thermofusible compounds is added, although the static thermal coloring sensitivity can be increased to some extent by the addition of the thermofusible compounds. However, when a large amount of the thermofusible materials is employed, sticking and dust-adhesion problems occur in the course of thermal recording by a thermal head. Further, when the melting point of the thermofusible compounds employed is extremely low, the preservability of the thermosensitive recording sheets is significantly degraded so that fogging of the background of the recording material occurs during storage thereof.

For the purpose of advancing the dynamic thermal coloring sensitivity of the recording material, there have been proposed a method of smoothing the surface of the thermosensitive coloring layer, and a method of increasing the concentration of the coloring components which do not contribute to the coloring reaction of the thermosensitive recording material, such as fillers and binder agents.

The method of smoothing the surface of the thermosensitive coloring layer is usually carried out without difficulty by use of a super calender. However, this method has the shortcomings that the background of the thermosensitive coloring layer is colored during the calendering process and the surface of the thermosensitive coloring layer becomes so glossy that the appearance of the recording material is impaired.

A filler such as calcium carbonate, clay, and urea-formaldehyde resin may be added to the thermosensitive coloring layer to maintain the whiteness of the background of the coloring layer and to prevent the sticking and dust adhesion problems during the thermosensitive recording using a thermal head. Further a water-soluble binder agent may be added to the thermosensitive coloring layer to firmly bind the coloring components and other additives of the thermosensitive coloring layer to the support. When the amount of such a filler and a water-soluble binder agent is reduced, the desired properties for the thermosensitive recording material cannot be obtained.

Under such circumstances, there have been proposed thermosensitive recording materials, in which a heat insulating layer is interposed between a support and a thermosensitive coloring layer for the purpose of effectively utilizing the thermal energy provided by a thermal head, for example, in Japanese Laid-Open Patent Applications 55-164192, 59-5903, 59-171685, and 59-225987.

In the thermosensitive recording material disclosed in Japanese Laid-Open Patent Application 55-164192, the heat insulating layer has a smoothness of about 1,000 seconds even though the insulating layer is calendered. In the thermosensitive recording material disclosed in Japanese Laid-Open Patent Application 59-5903, the heat insulating layer is formed by allowing thermally expandable finely-divided particles to stand at 100° C. for one minute, without the surface of the heat insulating layer being subjected to any surface smoothing treatment. In the thermosensitive recording material disclosed in Japanese Laid-Open Patent Application 59-171685, a foamed heat insulating layer is formed by bringing a layer consisting essentially of a blowing agent and a thermoplastic polymeric material into contact with a rotary drum-type dryer which is heated to 110° C. The surface smoothness of this heat insulating layer, however, is not satisfactory. Furthermore, in Japanese Laid-Open Patent Application 59-225987, it is disclosed that a layer containing a filler and a binder agent is formed on a heat insulating layer which is formed by foaming an expandable plastic filler in an attempt to make the surface of the heat insulating layer smooth. However, this attempt is not successful.

Thus, a thermosensitive recording material having satisfactorily high dynamic coloring sensitivity, while maintaining high background whiteness and high heat resistant preservability, has not been obtained yet.

SUMMARY OF THE INVENTION

It is therefore an object of the present invention to provide a thermosensitive recording material having high dynamic thermal coloring sensitivity, capable of yielding clear images with high density by application of a small amount of thermal energy thereto, with other necessary performance characteristics for the thermosensitive recording material being maintained, such as good thermal head matching performance free from the problem of sticking between the thermal head and the recording material, sufficiently high background whiteness, and heat resistant preservability.

The above object of the present invention can be achieved by a thermosensitive recording material comprising a support, an intermediate layer including a foamed portion with minute voids formed on the support, having a smoothness of 2,000 seconds or more in terms of Bekk's smoothness at the front surface thereof, formed on the support, and a thermosensitive coloring layer formed on the intermediate layer.

Further for achieving the above object of the present invention, it is preferable that the compression strain of the whole layers, i.e., the intermediate layer, including a resin layer or an undercoat layer, if any, and the thermosensitive coloring layer, which are overlaid on the support be 20% or more, and more preferably in the range of 20% to 50%, and that the compression strain of the entire thermosensitive recording material including the support be 5% or more, and more preferably in the range of 5% to 20%, when a pressure of 0.55 kg/cm$^2$ is applied, as measured in accordance with the Japanese Industrial Standards (JIS) P-8118.

DETAILED DESCRIPTION OF THE PREFERRED EMBODIMENTS

The thermosensitive recording material according to the present invention comprises an intermediate layer including a foamed portion with minute voids, having smoothness of 2,000 seconds or more in terms of Bekk's smoothness, between a support and a thermosensitive coloring layer. In the present invention, because of the use of the intermediate layer having a high heat insulating effect and surface smoothness, the thermal energy provided by a thermal head can be effectively absorbed in the thermosensitive coloring layer, and accordingly the dynamic coloring sensitivity can be remarkably improved.

In the thermosensitive recording material for use in the present invention, the surface of the thermosensitive coloring layer is so uniform that the calendering can impart a further smoothness to the thermosensitive coloring layer even under the application of low pressure. As a result, sufficiently high background whiteness and heat resistant preservability can be obtained.

In the present invention, the smoothness of the intermediate layer surface is 2,000 seconds or more, preferably 2,500 seconds or more and even more preferably 3,000 seconds or more in terms of Bekk's smoothness. In the case where the above-mentioned smoothness is less than 2,000 seconds, the thermosensitive coloring layer is not overlaid on the intermediate layer uniformly, so that the thermosensitive coloring layer cannot be brought into contact with a thermal head closely enough to obtain a high thermosensitivity.

The Bekk's smoothness is defined by the Japanese Industrial Standard (JIS-P8118). Specifically, it is defined as the period of time in seconds required for 10 ml of air to flow between a sample sheet to be tested and a flat plate having an effective contact area of 10 cm$^2$ on which the sample sheet has been placed, under conditions such that the air is drawn so as to flow between the sample sheet and the flat plate with the pressure difference of 370 mm Hg, with a vertical pressure of 1 kg/cm$^2$ being applied to the sample sheet on the flat plate.

The intermediate layer including a foamed portion with minute voids for use in the present invention can be formed, for example, by any of the following three methods: (1) a method of forming an intermediate layer on a support, which intermediate layer contains an expandable plastic filler comprising hollow particles made of a thermoplastic material and a solvent having a low boiling point which is contained in the particles, followed by applying heat to the intermediate layer to expand the intermediate layer; (2) a method of providing an intermediate layer containing (i) a blowing agent from which a gas such as $CO_2$, $N_2$, $NH_3$, or $O_2$ is generated upon application of heat and (ii) a thermoplastic polymeric material on a support, and applying heat to the intermediate layer to form an intermediate layer with a cell-like structure; and (3) a method of providing on a support an intermediate layer which includes minute void particles comprising hollow particles made of a thermoplastic material and air and other gasses contained in the particles.

The present invention is not limited to the above methods (1) to (3).

More specifically, the expandable plastic filler material employed in the above-mentioned method (1) are unexpanded plastic filler particles in the form of minute void particles, which comprise a thermoplastic material serving as the hollow particle and a low boiling point solvent placed therein. As such plastic fillers, a variety of conventional materials, known in the field of thermosensitive recording materials, can be employed. As the thermoplastic resin for the particle of such plastic fillers, polystyrene, polyvinyl chloride, polyvinylidene chloride, polyvinyl acetate, polyacrylic acid ester, polyacrylonitrile, polybutadiene and copolymers of the above can be employed.

As the low boiling point solvent placed in the particle, propane and butane can be generally employed.

Specific examples of a blowing agent employed in the method (2) are an inorganic compound such as sodium bicarbonate, ammonium bicarbonate and ammonium carbonate; a nitroso compound such as N,N-dinitrosopentamethylenetetramine, N,N'-dimethyl-N,N'-dinitrosoterephthalamide; an azo compound such as azodicarbonamide, azobisisobutyronitrile and barium azodicarboxylate; and a sulfonyl hydrazide compound such as benzenesulfonyl hydrazide and toluenesulfonyl hydrazide.

The thermoplastic polymeric materials used with the above blowing agents are softened by application of heat thereto and expanded by a gas generated when the blowing agents are decomposed, and eventually become spongy. As such a thermoplastic polymeric material, the same polymers and copolymers as those employed as the thermoplastic resin for the particle of the above-mentioned plastic filler can be used.

When a blowing agent and a thermoplastic resin are employed as in method (2), the content of the blowing agent is generally in the range from 1–50 parts by weight, preferably in the range from 2–20 parts by weight relative to 100 parts by weight of the thermoplastic resin.

The minute void particles employed in the method (3) are plastic void particles in the expanded state, in which air and other gasses are contained in the particle made of the thermoplastic material. As such plastic void particles, commercially available plastic void particles equipped with the above property can be employed. In addition, such plastic void particles may be prepared by expanding the above-mentioned expandable plastic filler with the application of heat thereto, and further compressing the expanded particles to substitute air and other gasses contained in the particle for propane and butane.

When the methods (1) and (2) are employed, the above-mentioned intermediate layer including a foamed portion with minute voids can be formed on a support by dispersing an expandable plastic filler, or a blowing agent and a thermoplastic polymeric material in water, together with a binder agent such as a conventional water-soluble polymeric material or a water-soluble emulsion thereof, coating the thus prepared dispersion on the surface of the support, and then expanding the same under the application of heat. In the case where the method (3) is employed, the intermediate layer can be formed on a support by coating the dispersion comprising minute void particles onto the support and then drying.

When an expandable plastic filler is employed, the amount of binder is generally in the range from 1–50 wt. %, preferably in the range from 1–20 wt. % of the total amount of the binder agent and the expandable plastic filler.

When the method (1) is employed, from the viewpoint of improvement in heat insulating effect it is preferable that expandable plastic filler be subjected to compression after the expanding process with the application of heat thereto so as to substitute air in the plastic filler for such gasses as propane and butane.

According to the present invention, a binder agent for use in the intermediate layer may be selected from the conventional hydrophobic polymeric emulsions and/or the water-soluble polymeric materials.

Examples of hydrophobic polymeric emulsions are emulsions of styrene—butadiene copolymer latex, acrylonitrile—butadiene—styrene copolymer latex, vinyl acetate resin, vinyl acetate—acrylic acid copolymer, styrene—acrylic acid ester copolymer, acrylic acid ester resin, and polyurethane resin.

Examples of water-soluble polymers are polyvinyl alcohol, starch, starch derivatives, cellulose derivatives such as methoxycellulose, hydroxyethylcellulose, carboxymethylcellulose, methylcellulose, and ethylcellulose, and other water-soluble polymers such as sodium polyacrylate, polyvinyl pyrrolidone, acrylamide—acrylic acid ester copolymer, acrylamide—acrylic acid ester—methacrylic acid copolymer, alkali salts of styrene—maleic anhydride copolymer, alkali salts of isobutylene—maleic anhydride copolymer, polyacrylamide, sodium alginate, gelatin and casein.

According to the present invention, when necessary, an undercoat layer comprising as the main components a binder agent and a filler may be interposed between the intermediate layer including a foamed portion with minute voids and the support or between the intermediate layer and the thermosensitive coloring layer.

As the binder agent for the undercoat layer, the above-mentioned binder agents employed for the formation of the intermediate layer can be used. In addition, the combination of a water-soluble polymer and a water-resisting agent may be employed.

As the filler for the undercoat layer, an inorganic filler such as calcium carbonate, silica, zinc oxide, titanium oxide, aluminum hydroxide, zinc hydroxide, barium sulfate, clay, talc, surface-treated calcium, and surface-treated silica, and an organic filler such as urea—formaldehyde resin, styrene—methacrylic acid copolymer, and polystyrene resin.

According to the present invention, the intermediate layer including a foamed portion with minute voids may be formed alone or as a combination of several layers. When a plurality of the intermediate layers is formed, it is preferable that the surface smoothness of each of the other intermediate layers as well as the topmost intermediate layer be 2,000 seconds or more.

The above-mentioned undercoat layer can also be formed alone or as multiple layers. In the case where the undercoat layers are interposed between the support and the intermediate layer, it is preferable that the surface smoothness of the intermediate layer be 2,000 seconds or more, while when the undercoat layers are interposed between the intermediate layer and thermosensitive coloring layer, it is preferable that at least the topmost undercoat layer have the surface smoothness of 2,000 seconds or more.

In order to obtain the intermediate layer including a foamed portion with minute voids with a surface smoothness of 2,000 seconds or more, it is preferable that the intermediate layer be subjected to calendering after being formed on the support. Such a calendering process can impart a desired surface smoothness of the intermediate layer without difficulty. Any conventional calendering process may be used in the present invention.

According to the present invention, the thermosensitive coloring layer comprising as the main components a conventionally used leuco dye and a color developer is formed on the intermediate layer including a foamed portion with minute voids or the undercoat layer comprising as the main components a binder agent and a filler.

In the present invention it is preferable that the compression strain of the layers, i.e., the intermediate layer including a foamed portion with minute voids, a resin layer or an undercoat layer comprising a binder agent and a filler which are provided when necessary, and the thermosensitive coloring layer, all of which are overlaid on the support be 20% or more, and more preferably in the range of 20% to 50%, and that the compression strain of the entire thermosensitive recording material including the support be 5% or more, and more preferably in the range of 5% to 20%, when a pressure of 0.55 kg/cm$^2$ is applied. The thermosensitive recording material which satisfies the above-mentioned requirements can keep close contact between the thermosensitive coloring layer and a thermal head, so that clear images with high density can be obtained.

The compression strain herein referred to is expressed as the ratio (percentage) of the thickness of thermosensitive recording material or that of all layers formed on the support measured under application of 0.55 kg/cm$^2$ pressure to the thickness of thermosensitive recording material or that of all layers formed on the support measured without any application of pressure. The conditions for applying a pressure of 0.55 kg/cm$^2$ are in accordance with the Japanese Industrial Standards (JIS) P-8118.

As the leuco dye for use in the present invention, which is employed alone or in combination, any conventional leuco dyes for use in conventional thermosensitive recording materials can be employed. For example, triphenylmethane-type leuco compounds, fluoran-type leuco compounds, phenothiazine-type leuco compounds, auramine-type leuco compounds, spiropyran-type leuco compounds and indolinophthalide-type leuco compounds are preferably employed.

Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluran,
3-dimethylamino-5,7-dimethylfluoran,
3-diethylamino-7-chlorofluran,
3-diethylamino-7-methylfluoran,
3-diethylamino-7,8-benzfluoran,
3--diethylamino-6-methyl-7-chlorofluran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]6-diethylaminofluoran,
2-[3,5-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino) fluoran,
benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methox-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-(N-ethyl-N-isoamyl)amino-6-methyl-7-anilinofluoran,
3-(N-ethyl-N-tetrahydrofurfuryl)amino-6-methyl-7-anilinofluoran,
3-(N-ethyl-N-ethoxypropyl)amino-6-methyl-7-anilinofluoran,
3-(N-methyl-N-isopropyl)amino-6-methyl-7-anilinofluoran,
3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino) fluoran,
3-(N-ethyl-p-toluidino)-7-(α-phenylethylamino)-fluoran,
3-diethylamino-7-(o-methoxycarbonylphenylamino)fluoran,
3-diethylamino-5-methyl-7-(α-phenylethylamino) fluoran,
3-diethylamino-7-piperidinofluoran,
2-chloro-3-(N-methyltoluidino)-7-(p-n-butylanilino)fluoran,
3-(N-benzyl-N-cyclohexylamino)5,6-benzo-7-α- naphthyl-amino-4'-bromofluoran, and
3-diethylamino-6-methyl-7-mesidino-4',5'-benzofluoran.

As the color developers for use in combination with the above leuco dyes in the present invention, capable of inducing color formation in the leuco dyes, a variety of electron acceptors can be employed, such as phenolic materials, organic and inorganic acids, and esters and salts thereof.

Specific examples of such color developers are gallic acid, salicylic acid, 3-isopropyl salicylic acid, 3-cyclohexyl salicylic acid, 3,5-di-tert-butyl salicylic acid, 3,5-di-α- methylbenzyl salicylic acid, 4,4'-isopropylidene-diphenol, 4,4'-isopropylidenebis(2-chlorophenol), 4,4'-isopropylidenebis(2,6-dibromophenol), 4,4'-isopropylidenebis(2,6-dichlorophenol), 4,4'-isopropylidenebis(2-methyl-phenol), 4,4'-isopropylidenebis(2,6-dimethylphenol), 4,4'-isopropylidenebis(2-tert-butylphenol), 4,4'-sec-butylidenediphenol, 4,4'-cyclohexylidenebisphenol, 4,4'-cyclohexylidenebis(2-methylphenol), 4-tert-butylphenol, 4-phenylphenol, 4-hydroxy-diphenoxide, α-naphthol, β-naphthol, 3,5-xylenol, thymol, methyl-4-hydroxybenzoate, 4-hydroxyacetophenone, novolak-type phenolic resins, 2,2'-thiobis(4,6-dichlorophenol), catechol, resorcinol, hydroquinone, pyrogallol, phloroglucin, phloroglucinolcarboxylic acid, 4-tert-octylcatechol, 2,2'-methylenebis(4-chlorophenol), 2,2'-methylenebis-(4-methyl-6-tert-butylphenol), 2,2'-dihydroxydiphenyl, ethyl p-hydroxybenzoate, propyl p-hydroxybenzoate, butyl p-hydroxybenzoate, benzyl p-hydroxybenzoate, p-chlorobenzyl p-hydroxybenzoate,, o-chlorobenzyl p-hydroxybenzoate, p-methylbenzyl p-hydroxybenzoate, n-octyl p-hydroxybenzoate, benzoic acid, zinc salicylate, 1-hydroxy-2-naphthoic acid, 2-hydroxy-6-naphthoic acid, zinc 2-hydroxy-6-naphthoic acid, 4-hydroxy-diphenylsulfone, 4-hydroxy-4'-chlorodiphenylsulfone, bis(4-hydroxyphenyl)sulfide, 2-hydroxy-p-toluic acid, zinc 3,5-di-tert-butylsalicylate, tin 3,5-di-tert-butyl-salicylate, tartaric acid, oxalic acid, maleic acid, citric acid, succinic acid, stearic acid, 4-hydroxy-phthalic acid, boric acid, thiourea derivatives, 4-hydroxythiophenol derivatives, bis(4-hydroxyphenyl-)acetate, bis(4-hydroxyphenyl)methyl acetate, bis(4-hydroxyphenyl)ethyl acetate, bis(4-hydroxyphenyl)n-propyl acetate, bis(4-hydroxyphenyl)n-butyl acetate, bis(4-hydroxyphenyl)phenyl acetate, bis(4-hydroxyphenyl)benzyl acetate, bis(4-hydroxyphenyl)phenethyl acetate, bis(3-methyl-4hydroxyphenyl)acetate, bis(3-methyl-4-hydroxyphenyl)methyl acetate, bis(3-methyl-4-hydroxyphenyl)ethyl acetate, bis(3-methyl-4-hydroxyphenyl)n-propyl acetate, 1,7-bis(4-hydroxyphenylthio)3,5-dioxaheptane, 1,5-di(4-hydroxyphenylthio)-3-oxapentane, 4-dimethyl hydroxyphthalate, 4-hydroxy-4'-methoxydiphenylsulfone, 4-hydroxy-4'-ethoxydiphenylsulfone, 4-hydroxy-4'-isopropoxydiphenylsulfone, 4-hydroxy-4'-n-propoxydiphenylsulfone, 4-hydroxy-4'-n-butoxydiphenylsulfone, 4-hydroxy-4'-isobutoxydiphenylsulfone, 4-hydroxy-4'-sec-butoxydiphenylsulfone, 4-hydroxy-4'-tert-butoxydiphenylsulfone, 4-hydroxy-4'-hydroxy-4-b 4-hydroxy-4'-phenoxydiphenylsulfone, 4-hydroxy-4'-(m-methylbenzyloxy)diphenylsulfone, 4-hydroxy-4'-(p-methyl-benzyloxy)diphenylsulfone, 4-hydroxy-4'-(o-methylbenzyloxy)diphenylsulfone, and 4-hydroxy-4'-(p-chlorobenzyloxy) diphenylsulfone.

In the present invention, a variety of conventional binder agents can be employed for binding the above-mentioned leuco dyes and color developers to the support. Specific examples of such binder agents are the same as those employed in the intermediate layer including a foamed portion with minute voids.

Further in the present invention, auxiliary additive components which are employed in the conventional thermosensitive recording materials, such as a filler, a surface active agent and a thermofusible material (or unguent), can be employed together with the above-mentioned leuco dyes and color developers.

As the filler, the same inorganic fillers and/or organic fillers are those employed in the above-mentioned undercoat layer can be used.

As the thermofusible material, for example, higher fatty acids, esters, amides and metallic salts thereof, waxes, condensation products of aromatic carboxylic acids and amines, benzoic acid phenyl esters, higher straight chain glycols, 3,4-epoxy-dialkyl hexahydrophthalate, higher ketones and other thermofusible organic compounds having melting points ranging from about 50° C. to 200° C. can be employed.

In the thermosensitive recording material for use in the present invention, a protective layer may be formed on the thermosensitive coloring layer for the purpose of improving the thermal head matching performance and increasing the preservability of recorded images. In such cases, the above-mentioned fillers, binder agents, surface active agents, and thermofusible materials may be employed as the components for the protective layer.

According to the present invention, the thermosensitive recording material can be constructed by overlaying the above-described intermediate layer having a foamed portion with numerous minute voids therein and the thermosensitive coloring layer on the support such as paper, synthetic paper, or plastic film.

Other features of the invention will become apparent in the course of the following descriptions of the exemplary embodiments which are given for illustration of the invention and are not intended to be limiting thereof.

EXAMPLES

Example 1—Preparation of Intermediate Layer Coating Liquid (A-1)

A mixture of the following components was dispersed in a homogenizer, whereby an intermediate layer coating liquid (A-1) was prepared.

| | Parts by Weight |
|---|---|
| Expandable minute void particles (Trademark "Micro Pearl F30" made by Matsumoto Yushi-Seiyaku Co., Ltd.) | 10 |
| 10% aqueous solution of polyvinyl alcohol | 10 |
| Water | 80 |

The above intermediate layer coating liquid (A-1) was coated onto a sheet of commercially available high quality paper having basis weight of 52 g/m$^2$ in a deposition amount of 5.0 g/m$^2$ on dry basis in an unexpanded state, and the coated liquid was dried to form an intermediate layer. The coated surface of the intermediate layer was then brought into close contact with the surface of a rotary type drum dryer having a built-in heater, so that the intermediate layer was expanded at a surface temperature of 110° C. with application of heat thereto, and was then subjected to calendering so as to obtain the smoothness of 2,000 seconds, whereby a coated sheet (A-1) was prepared.

Preparation of Thermosensitive Coloring Layer Coating Liquid (B-1)

Liquid (C-1) and Liquid (D-1) were prepared by grinding and dispersing the following respective mixtures separately in a ball mill. Composition of Liquid (C-1)

| | Parts by Weight |
|---|---|
| 3-(N-cyclohexyl-N-methyl)amino-6-methyl-7-anilinofluoran | 30 |
| 20% aqueous solution of polyvinyl alcohol | 30 |
| Water | 40 |

Composition of Liquid (D-1)L

| | Parts by Weight |
|---|---|
| Benzyl-p-hydroxybenzoate | 15 |
| 2,2'-methylenebis(3-methyl-6-t-butylphenol) | 5 |
| Calcium carbonate | 10 |
| 10% aqueous solution of polyvinyl alcohol | 20 |
| Water | 50 |

A mixture of Liquid (C-1) and Liquid (D-1) with a mixing ratio of 1:8 by weight was stirred, so that a thermosensitive coloring layer coating liquid (B-1) was prepared.

This thermosensitive coloring layer coating liquid (B-1) was coated onto the surface of the above-prepared coated sheet (A-1) in a deposition amount of 5.0 g/m$^2$ on dry basis by using a wire bar, and the coated liquid was dried to form a thermosensitive coloring layer. The thus formed thermosensitive coloring layer was calendered under application of as low a nip pressure as possible so as to obtain the smoothness of 2,000 seconds, whereby a thermosensitive recording sheet No. 1 according to the present invention was prepared.

Example 2

A mixture of the following components was dispersed in a homogenizer whereby an undercoat layer coating liquid (E-1) was prepared.

| | Parts by Weight |
|---|---|
| Barium sulfate | 20 |
| Styrene - butadiene copolymer | 20 |
| Water | 60 |

The above undercoat layer coating liquid (E-1) was coated onto the same coated sheet (A-1) as employed in Example 1 in a deposition amount of 3.0 g/m$^2$ on dry basis, and the coated liquid was dried to form an undercoat layer. The thus formed undercoat layer was then subjected to calendering so as to obtain a smoothness of 5,000 seconds.

The same thermosensitive coloring layer coating liquid (B-1) as employed in Example 1 was coated on the above-prepared undercoat layer in the same manner as in Example 1, whereby a thermosensitive recording sheet No. 2 according to the present invention was prepared.

Example 3—Preparation of Intermediate Layer Coating Liquid (A-1)

A mixture of the following components was dispersed in a homogenizer whereby an intermediate layer coating liquid (A-2) was prepared.

| | Parts by Weight |
|---|---|
| Expandable minute void particles (Trademark "Expancel DE" made by Nippon Ferrite Co., Ltd.) | 10 |
| 10% aqueous solution of polyvinyl alcohol | 10 |
| Water | 80 |

The above intermediate layer coating liquid (A-2) was coated onto a sheet of commercially available high quality paper in a deposition amount of 5.0 g/m$^2$ on dry basis in an unexpanded state, and the coated liquid was dried to form an intermediate layer. The thus formed intermediate layer was then subjected to calendering so as to substitute air contained in the expandable minute void particles for butane, whereby a coated sheet (A-2) was prepared.

The same undercoat layer coating liquid (E-1) as employed in Example 2 was coated onto the above-prepared coated sheet (A-2) in a deposition amount of 3.0 g/m$^2$ on dry basis and dried. The thus formed undercoat layer was then subjected to calendering so as to obtain the smoothness of 2,000 seconds.

The same thermosensitive coloring layer coating liquid (B-1) as employed in Example 1 was coated on the above-prepared undercoat layer, dried, and then subjected to further calendering to obtain the smoothness of 2,000 seconds, whereby a thermosensitive recording sheet No. 3 according to the present invention was prepared.

Example 4

Example 2 was repeated except that the same undercoat layer coating liquid (E-1) as employed in Example 2 was coated onto a support in a deposition amount of 3.0 g/m$^2$ on dry basis, whereby a thermosensitive recording sheet No. 4 according to the present invention wa prepared.

Comparative Example 1

Example 1 was repeated except that the intermediate layer was not expanded under application of heat thereto, whereby a comparative thermosensitive recording sheet No. 1 was prepared.

Comparative Example 2

Example 1 was repeated except that the intermediate layer was subjected to calendering so as to obtain the smoothness of 1,000 seconds, whereby a comparative thermosensitive recording sheet No. 2 was prepared.

The thermosensitive recording sheets No. 1 through No. 4 according to the present invention and the comparative thermosensitive recording sheets No. 1 and No. 2 were subjected to dynamic thermal coloring sensitivity tests, background density tests, and heat resistance test. The results are shown in Table 1.

Each of the tests was carried out as follows:

(1) Dynamic thermal coloring sensitivity test:

The dynamic thermal coloring sensitivity test was conducted by performing thermal printing on each of the above thermosensitive recording sheets by a thermosensitive printing test apparatus having a thin film thermal head (made by Matsushita Electronic Components Co., Ltd.), under such conditions that the electric power applied to the thermal head was 0.60 w/dot, the recording period of time was 5 ms/line, the scanning density was 8×3.85 dot/mm, with the pulse width changed to 0.1 msec, 0.2 msec, 0.3 msec, and 0.4 msec. The image densities of the formed images were measured by use of a Macbeth densitometer RD-514 with a filter Wratten-106 attached thereto.

(2) Background density test:

Samples were allowed to stand at 60° C. at a low humidity (not measured), and then the background densities of the thermosensitive recording sheets were measured by use of a Macbeth densitometer RD-514 with a filter Wratten-106 attached thereto.

(3) Heat resistance test:

The background densities of the thermosensitive recording sheets were measured after stored at 60° C. for 24 hours.

TABLE 1

| Example No. | Dynamic Thermal Coloring Sensitivity 0.1 msec. | 0.2 msec. | 0.3 msec. | 0.4 msec | Background Density | Heat Resistance |
|---|---|---|---|---|---|---|
| Example 1 | 0.13 | 0.50 | 1.30 | 1.35 | 0.08 | 0.10 |

TABLE 1-continued

| Example No. | Dynamic Thermal Coloring Sensitivity 0.1 msec. | 0.2 msec. | 0.3 msec. | 0.4 msec | Background Density | Heat Resistance |
|---|---|---|---|---|---|---|
| Example 2 | 0.12 | 0.63 | 1.34 | 1.37 | 0.08 | 0.10 |
| Example 3 | 0.12 | 0.58 | 1.33 | 1.36 | 0.08 | 0.11 |
| Example 4 | 0.14 | 0.70 | 1.35 | 1.37 | 0.08 | 0.10 |
| Comparative Example 1 | 0.11 | 0.22 | 0.45 | 1.00 | 0.11 | 0.20 |
| Comparative Example 2 | 0.10 | 0.30 | 1.03 | 1.32 | 0.10 | 0.15 |

As shown in Table 1, thermosensitive recording sheets according to the present invention show excellent coloring performance at the high speed thermosensitive recording. In addition, the background whiteness and heat resistance preservability are superior.

Example 5—Preparation of Intermediate Layer Coating Liquid (A-2)

A mixture of the following components was dispersed in a dispersing apparatus, whereby an intermediate layer coating liquid (A-3) was prepared:

| | Parts by Weight |
|---|---|
| Expandable plastic filler (Trademark "Matsumoto Micro Sphere F30" made by Matsumoto Yushi-Seiyaku Co., Ltd.) (Hollow particle: Vinylidene chloride-acrylonitrile copolymer Solvent in the particle: Isobutane) | 15 |
| 10% aqueous solution of polyvinyl alcohol | 30 |
| Water | 60 |

The above intermediate layer coating liquid (A-3) was coated on a sheet of commercially available high quality paper in a deposition amount of 3.0 g/m$^2$ on dry basis in an unexpanded state, and the coated liquid was dried to form an intermediate layer. The coated surface of the intermediate layer was then brought into close contact with the surface of a rotary type drum dryer having a built-in heater, so that the intermediate layer was expanded at a surface temperature of 120° C. with application of heat thereto for about 2 minutes, and then subjected to calendering under application of calender pressure of 5 kg/cm$^2$, whereby a coated sheet (A-3) was prepared.

Preparation of Thermosensitive Coloring Layer Coating Liquid (B-2)

Liquid (C-2) and Liquid (D-2) were prepared by grinding and dispersing the following respective mixtures separately in a sand grinder until the volume mean diameter of the dispersed particles became about 1.5 μm (measured by Coulter counter):

Composition of Liquid (C-2)

| | Parts by Weight |
|---|---|
| 3-N-cyclohexyl-N-methyl)amino-6-methyl-7-anilinofluoran | 20 |
| 10% aqueous solution of polyvinyl alcohol | 16 |

-continued

| | Parts by Weight |
|---|---|
| Water | 64 |

Composition of Liquid (D-2)

| | Parts by Weight |
|---|---|
| Benzyl p-hydroxybenzoate | 20 |
| Calcium carbonate | 20 |
| 10% aqueous solution of polyvinyl alcohol | 30 |
| Water | 30 |

A mixture of Liquid (C-2) and Liquid (D-2) with a mixing ratio of 1:4 by weight was stirred, so that a thermosensitive coloring layer coating liquid (B-2) was prepared.

This thermosensitive coloring layer coating liquid (B-2) was coated onto the surface of the above-prepared coated sheet (A-2) in a deposition amount of 4.5 g/m$^2$ on dry basis, and the coated liquid was dried to form a thermosensitive coloring layer. The thus formed thermosensitive coloring layer was subjected to calendering under the calender pressure of 5 kg/cm$^2$, whereby a thermosensitive recording sheet No. 5 according to the present invention was prepared.

The thickness of the thus prepared thermosensitive recording sheet No. 5 was measured, without any pressure applied, from the sectional picture taken by a microscope. Then the thickness of the thermosensitive recording sheet No. 5 was measured in accordance with the Japanese Industrial Standards (JIS) P-8118, with 0.55 kg/cm$^2$-pressure applied. From the above two measurements, the compression strain of the thermosensitive recording sheet No. 5 was calculated at 7%.

Further, the thicknesses of a sheet of high quality paper serving as a support was measured without any pressure, and with 0.55 kg/cm$^2$-pressure applied. As a result, the compression strain of only the coated layer was calculated at 28%.

Examples 6 through 9, and Comparative Examples 3 and 4

Example 5 was repeated except that the conditions of a deposition amount on dry basis of the intermediate layer coating liquid, the surface temperature of a rotary type drum dryer, and calender pressure were changed as shown in Table 2, whereby thermosensitive recording sheets No. 6 through No. 9 according to the present invention and comparative thermosensitive recording sheets No. 3 and No. 4 having respective compression strains as shown in Table 2 were prepared.

TABLE 2

| Example No. | Deposition Amount on Dry Basis ($g/m^2$) | Surface Temperature of Drum dryer (°C.) | Calender Pressure ($kg/cm^2$) | Compression Strain of Thermosensitive Recording Sheet (%) | Compression Strain of Coated Layers (%) |
|---|---|---|---|---|---|
| Example 6 | 2.0 | 120 | 3 | 5.5 | 23 |
| Example 7 | 4.0 | 120 | 5 | 9.3 | 35 |
| Example 8 | 4.0 | 120 | 10 | 7.2 | 29 |
| Example 9 | 5.0 | 120 | 10 | 11.0 | 38 |
| Comparative Example 3 | 3.0 | 120 | 30 | 3.0 | 12 |
| Comparative Example 4 | 4.0 | 90 | 5 | 1.5 | 7 |

The thermosensitive recording sheets No. 6 through No. 9 according to the present invention and the comparative thermosensitive recording sheets No. 3 and No. 4 were subjected to dynamic thermal coloring sensitivity tests by use of a G-III facsimile test apparatus, and the image densities of the formed images were measured by use of a Macbeth densitometer with a filter Wratten-106 attached thereto.

More specifically, the dynamic thermal coloring sensitivity tests were conducted by performing thermal printing on each of the above thermosensitive recording sheets by a G-III facsimile test apparatus having an 8 dots/mm thermal head (commercially available by Matsushita Electronic Components co., Ltd.) including a heat generating resistor of about 400 Ω/dot, under conditions such that the main scanning recording speed was 20 msec/line, the sub-scanning density was 3.85 line/mm, the pressure application by a platen was 1.4 $kg/cm^2$, the electric power applied to the thermal head was 0.4 W/dot, and the electric power application time was 1.4 msec. The results were shown in Table 3.

As shown in Table 3, thermosensitive recording sheets according to the present invention can produce sharp images with high dynamic thermal coloring sensitivity with a small amount of thermal energy.

TABLE 3

| Example No. | Density of Printed Images |
|---|---|
| Example 5 | 1.32 |
| Example 6 | 1.28 |
| Example 7 | 1.35 |
| Example 8 | 1.37 |
| Example 9 | 1.37 |
| Comparative Example 3 | 1.21 |
| Comparative Example 4 | 1.05 |

Obviously, numerous modifications and variations of the present invention are possible in light of the above teachings. It is therefore to be understood that within the scope of the appended claims, the invention may be practiced otherwise than as specifically described herein.

What is new and desired to be secured by letters patent of the United States is:

1. A thermosensitive recording material consisting essentially of (i) a support, (ii) an intermediate layer including a foamed portion with minute voids, having a smoothness of 2,000 seconds or more in terms of Bekk's smoothness at the front surface thereof, formed on said support, and (iii) a thermosensitive coloring layer.

2. The thermosensitive recording material of claim 1, wherein the compression strain of components (ii) and (iii) is 20% or more when a pressure of 0.55 $kg/cm^2$ is applied in accordance with the Japanese Industrial Standards (JIS) P-8118.

3. The thermosensitive recording material of claim 2, wherein the compression strain of said intermediate layer and said thermosensitive coloring layer is in the range of 20% to 50% when a pressure of 0.55 $kg/cm^2$ is applied in accordance with the Japanese Standards (JIS) P-8118.

4. The thermosensitive recording material of claim 1, wherein the compression strain of components (i), (ii) and (iii) of said recording material is 5% or more when a pressure of 0.55 $kg/cm^2$ is applied in accordance with the Japanese Industrial Standards (JIS) P-8118.

5. the thermosensitive recording material of claim 4, wherein the compression ratio of components (i), (ii) and (iii) of said recording material is in the range of 5% to 20% when a pressure of 0.55 $kg/cm^2$ is applied in accordance with the Japanese Industrial Standards (JIS) P-8118.

6. The thermosensitive recording material of claim 1, wherein said intermediate layer is made of an expandable plastic material.

7. The thermosensitive recording material of claim 6, wherein said plastic material is selected from the group consisting of polystyrene, polyvinyl chloride, polyvinylidine chloride, polyvinyl acetate, polyacrylic acid ester, polyacrylonitrile, polybutadiene and copolymers thereof.

8. The thermosensitive recording material of claim 1, wherein said intermediate layer further comprises a binder agent.

9. The thermosensitive recording material of claim 8, wherein said binder agent comprises a hydrophobic polymer or a water-soluble polymer.

10. The thermosensitive recording material of claim 1, wherein said support comprises paper, synthetic paper or plastic film.

11. The thermosensitive recording material of claim 1, wherein said recording material has a Bekk's smoothness of 2,500 seconds or more.

12. The thermosensitive recording material of claim 11, wherein said recording material has a Bekk's smoothness of 3,000 seconds or more.

13. A thermosensitive recording material consisting essentially of (i) a support, (ii) an intermediate layer including a foamed portion with minute voids, calendered to a smoothness of 2,000 seconds or more in terms of Kekk's smoothness at the front surface thereof, formed on said support, and having an undercoat layer comprising a binder agent and a filler interposed between said intermediate layer and said support, and (iii) a thermosensitive coloring layer.

14. A thermosensitive recording material consisting essentially of (i) a support, (ii) an intermediate layer including a foamed portion with minute voids, calendered to a smoothness of 2,000 seconds or more in terms of Bekk's smoothness at the front surface thereof, formed on said support, (iii) a thermosensitive coloring layer and an undercoat layer comprising a binder agent and a filler interposed between said intermediate layer and said thermosensitive coloring layer.

15. A thermosensitive recording material consisting essentially of (i) a support, (ii) an intermediate layer including a foamed portion with minute voids, calendered to a smoothness of 2,000 seconds or more in terms of Bekk's smoothness at the front surface thereof, formed on said support, and wherein said intermediate layer comprises at least two intermediate layers wherein the topmost intermediate layer has a surface smoothness of 2,000 seconds or more, and (iii) a thermosensitive coloring layer.

* * * * *